US005918422A

United States Patent [19]

Bucher, Jr.

[11] Patent Number: 5,918,422

[45] Date of Patent: Jul. 6, 1999

[54] OPEN OFFICE PANEL SYSTEM

[76] Inventor: Robert Joseph Bucher, Jr., 3383 NY Route 43, Averill Park, N.Y. 12018

[21] Appl. No.: 08/856,110

[22] Filed: May 14, 1997

[51] Int. Cl.[6] ..... E04B 2/74

[52] U.S. Cl. ..... 52/36.5; 52/236.3; 52/239; 52/64; 52/67; 108/147.19; 160/137; 160/152; 160/159; 160/218

[58] Field of Search ..... 52/239, 481.2, 52/236.9, 243.1, 64, 36.1, 67; 108/144.11, 147.19; 160/135, 136, 137, 152, 159, 218, 221, 197, 202, 222, 229.1, 351, 229

[56] References Cited

U.S. PATENT DOCUMENTS

| | | | |
|---|---|---|---|
| 736,357 | 8/1903 | Brousseau . | |
| 862,152 | 8/1907 | German . | |
| 1,049,538 | 1/1913 | Sandt et al. . | |
| 1,093,119 | 4/1914 | Donavan . | |
| 1,864,077 | 6/1932 | Lewis et al. . | |
| 1,977,114 | 10/1934 | Chitwood . | |
| 3,204,689 | 9/1965 | Howell . | |
| 3,596,701 | 8/1971 | Cowan . | |
| 3,690,365 | 9/1972 | Thompson . | |
| 3,809,142 | 5/1974 | Bleeker . | |
| 3,817,396 | 6/1974 | Markson . | |
| 4,030,219 | 6/1977 | Donovan . | |
| 4,072,179 | 2/1978 | Naito | 160/197 |
| 4,224,769 | 9/1980 | Ball et al. . | |
| 4,831,791 | 5/1989 | Ball . | |
| 4,833,840 | 5/1989 | Kalischewski et al. | 52/243.1 |
| 4,876,835 | 10/1989 | Kelley et al. . | |
| 4,905,428 | 3/1990 | Sykes . | |
| 4,944,122 | 7/1990 | Wendt . | |
| 5,125,202 | 6/1992 | Kissinger | 52/239 |
| 5,212,915 | 5/1993 | Antonio . | |
| 5,255,478 | 10/1993 | Baranowski et al. . | |
| 5,259,164 | 11/1993 | Wiese . | |
| 5,394,658 | 3/1995 | Schreiner et al. . | |
| 5,398,468 | 3/1995 | Erickson . | |
| 5,433,046 | 7/1995 | MacQuarrie et al. | 52/238.1 |
| 5,486,391 | 1/1996 | Tyner | 52/239 |
| 5,495,952 | 3/1996 | Kainz | 52/239 |
| 5,501,051 | 3/1996 | Harlan | 52/239 |
| 5,528,859 | 6/1996 | Taylor et al. . | |
| 5,546,718 | 8/1996 | Way | 52/239 |

*Primary Examiner*—Carl D. Friedman
*Assistant Examiner*—Dennis L. Dorsey
*Attorney, Agent, or Firm*—Schmeiser, Olsen & Watts

[57] ABSTRACT

A vertically sliding adjustable office panel system that allows each panel to change height individually or in unison by virture of a panel within a panel sliding assembly. The panels are connected side by side to form office cubicles. The space dividing system adjusts vertically by inserting or removing connectors. This system allows a closed office cubicle system to become a partially or completely open workstation by raising or lowering any or all of the panels.

21 Claims, 21 Drawing Sheets

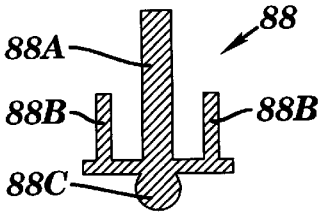
FIG. 14A
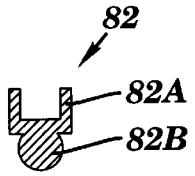
FIG. 16A
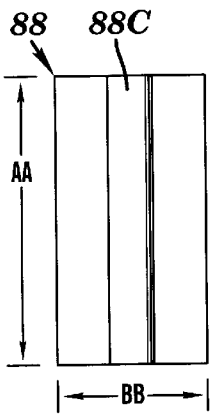
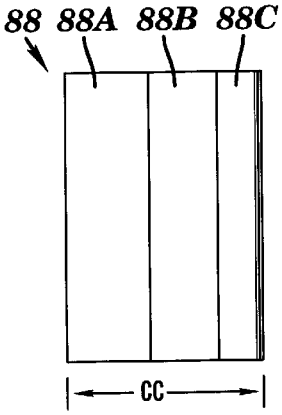
FIG. 14B FIG. 14C
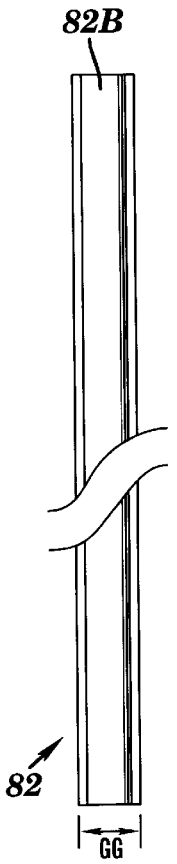
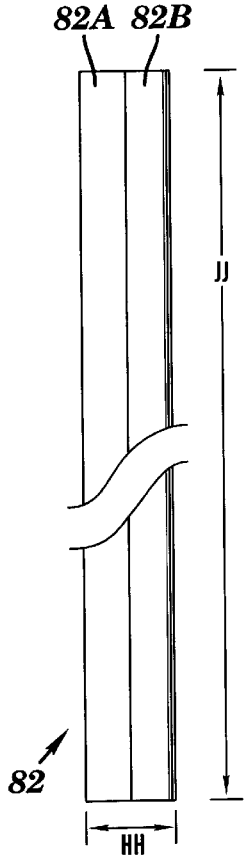
FIG. 16B FIG. 16C
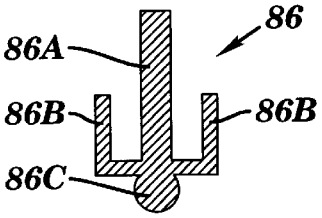
FIG. 15A
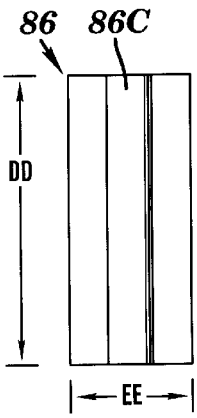
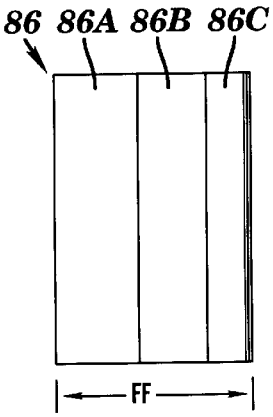
FIG. 15B FIG. 15C

OPEN OFFICE PANEL SYSTEM

BACKGROUND OF THE INVENTION

1. Field of the Invention

The invention relates to partition structures and to elements for use in their construction. More specifically, although not exclusively, it relates to a vertically adjustable partition system.

2. Description of Related Art

Presently in order to change height of panels the user must first have a professional office installer remove worksurfaces and components, remove the hinge systems on the appropriate panels, remove the panels themselves, purchase the new lower or higher replacements and then reinstall them. This process is not only costly, but adds downtime for reconfiguration.

SUMMARY OF THE PRESENT INVENTION

The present invention is an apparatus comprising a first panel portion having a first wall and a second wall; a second panel portion located between the first wall and second wall; and said second panel slidably adjustable between a first position and a second position.

The present invention is a partition comprising a lower panel portion; an upper panel portion located within the lower panel portion; and said upper panel portion being slidably positionable between a first position and a second position.

The present invention is a workspace managment system for dividing a room into separate work areas comprising: a plurality of panel units rigidly joined together at the edges to form at least one work area; each of said plurality of panel units having an upper panel portion within a lower panel portion so as to be able to change height individually or in unison.

The present invention is a method of slidably vertically changing the height of a partition using connectors.

BRIEF DESCRIPTION OF THE DRAWINGS

FIG. 14A shows a top view of a top connector of the second embodiment;

FIG. 14B shows a front view of a top connector of the second embodiment;

FIG. 14C shows a side view of a top connector of the second embodiment;

FIG. 15A shows a top view of a middle connector of the second embodiment;

FIG. 15B shows a front view of a middle connector of the second embodiment;

FIG. 15C shows a side view of a middle connector of the second embodiment;

FIG. 16A shows a top view of a bottom connector of the second embodiment;

FIG. 16B shows a front view of a bottom connector of the second embodiment;

FIG. 16C shows a side view of a bottom connector of the second embodiment;

DETAILED DESCRIPTION OF THE INVENTION

Although certain preferred embodiments of the present invention will be shown and described in detail, it should be understood that various changes and modifications may be made without departing from the scope of the appended claims. The scope of the present invention will in no way be limited to the quantities of constituting components, the materials thereof, the shapes thereof, the relative arrangement thereof, etc., and are disclosed simply as an example of the embodiment.

The present invention is an apparatus and method to improve the flexibility of the open office panel system to allow cubicles to be open networking type stations, a partially closed semi-private station or a completely closed private station all by simply changing the heights of the existing office panels. This invention relates to office space dividers also known as office cubicles, office landscaping, etc. and it enables a single workstation or a group of workstations to change from totally open to totally closed or any combination in between.

The present invention is an apparatus and method for using a vertically sliding adjustable office panel system that allows each panel to change height individually or in unison by virtue of a panel within a panel sliding assembly. The panels are connected side by side to form office cubicles. The space dividing system adjusts vertically by inserting or removing connectors to raise and lower the panel. These connectors attach to both sides of a panel junction to form the panel to panel connection, by removing the connectors at all four panel connections, the user is able to lower the panel height and by inserting the hinge connectors the use is able to raise the panel height. This system allows a closed office cubicle to become a partially or completely open workstation by raising or lowering any or all of the panels.

Referring now specifically to the drawings of illustrated embodiments of the present invention, wherein like reference numbers refer to like parts throughout the drawings.

Figure 1A:
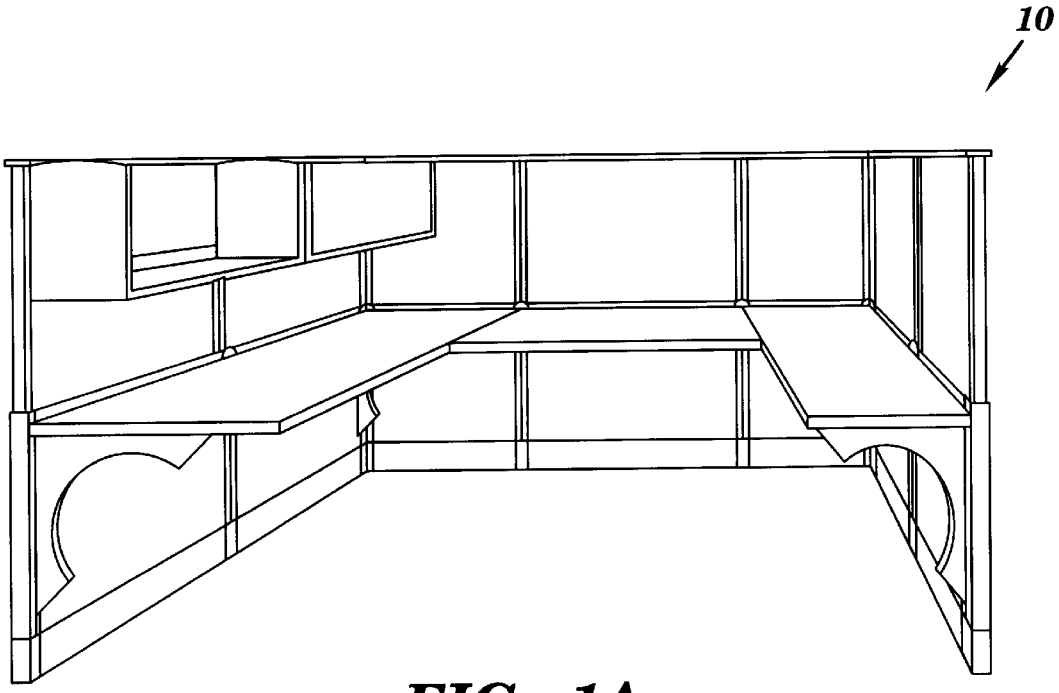
FIG. 1A shows a closed cubicle workstation using a first embodiment of the present invention.
Figure 1B:
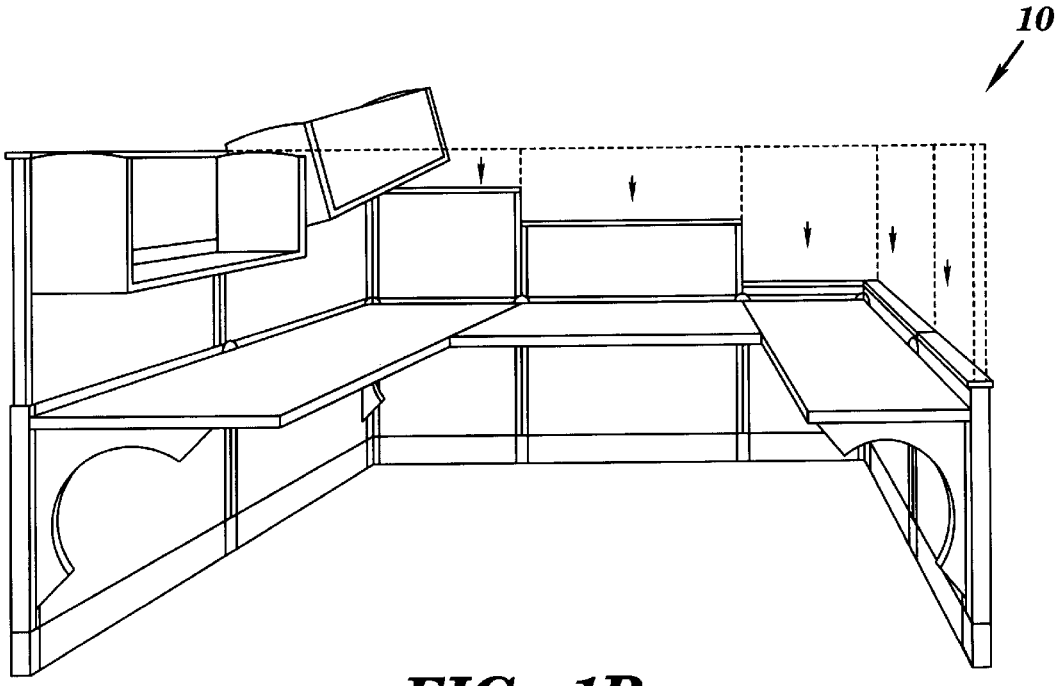
FIG. 1B shows a partially open workstation using the first embodiment of the present invention.
Figure 1C:
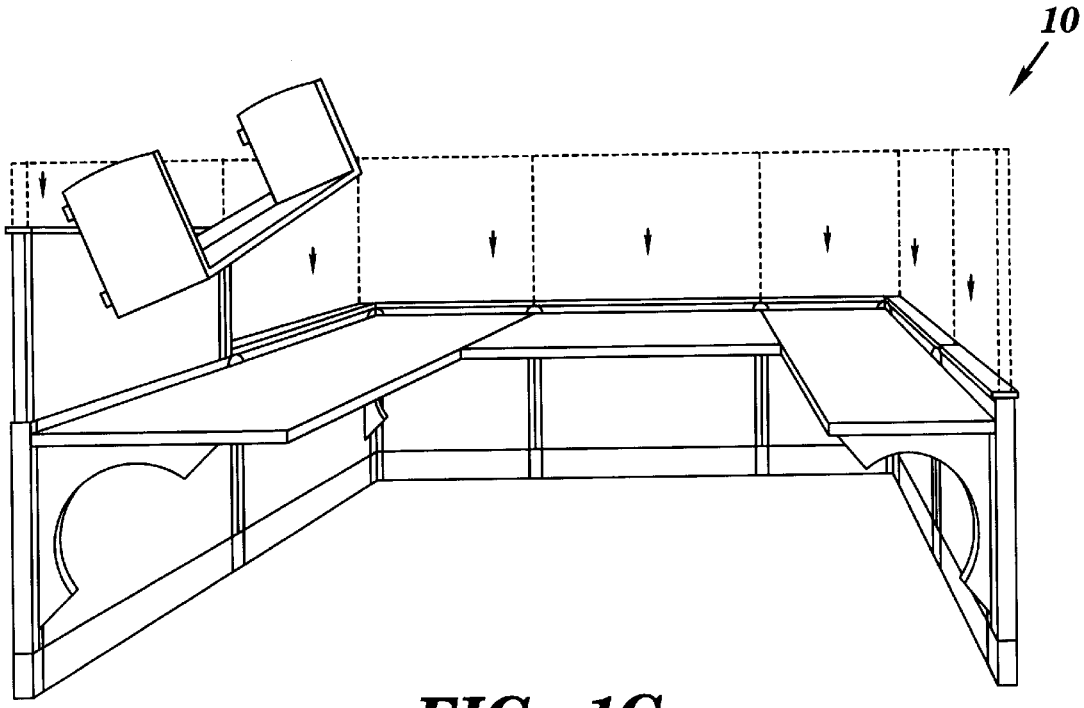
FIG. 1C shows an almost completely open workstation using the first embodiment of the present invention.
Figure 1D:
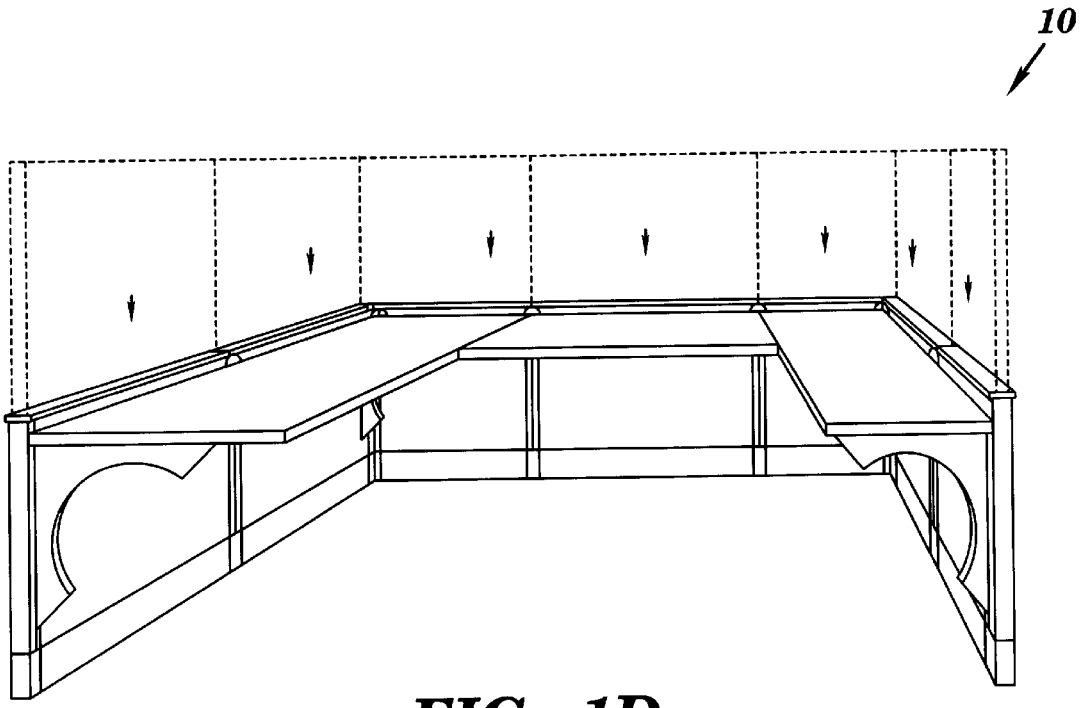
FIG. 1D shows a completely open workstation using the first embodiment of the present invention.

FIGS. 1A–1D show four possible positions that a typical workstation of the first embodiment could be configured in. The drawings show the total flexibility of the present invention and how it can convert from a totally private station to a completely open station with several variations. FIG. 1A shows a closed cubicle workstation system 10 using the present invention with accessories attached. FIG. 1B shows a partially open workstation system 10 using the present invention. FIG. 1C shows an almost completely open workstation system 10 using the present invention with the accessories easily removed. FIG. 1D shows a completely open workstation system 10 using the present invention.

Figure 2A:
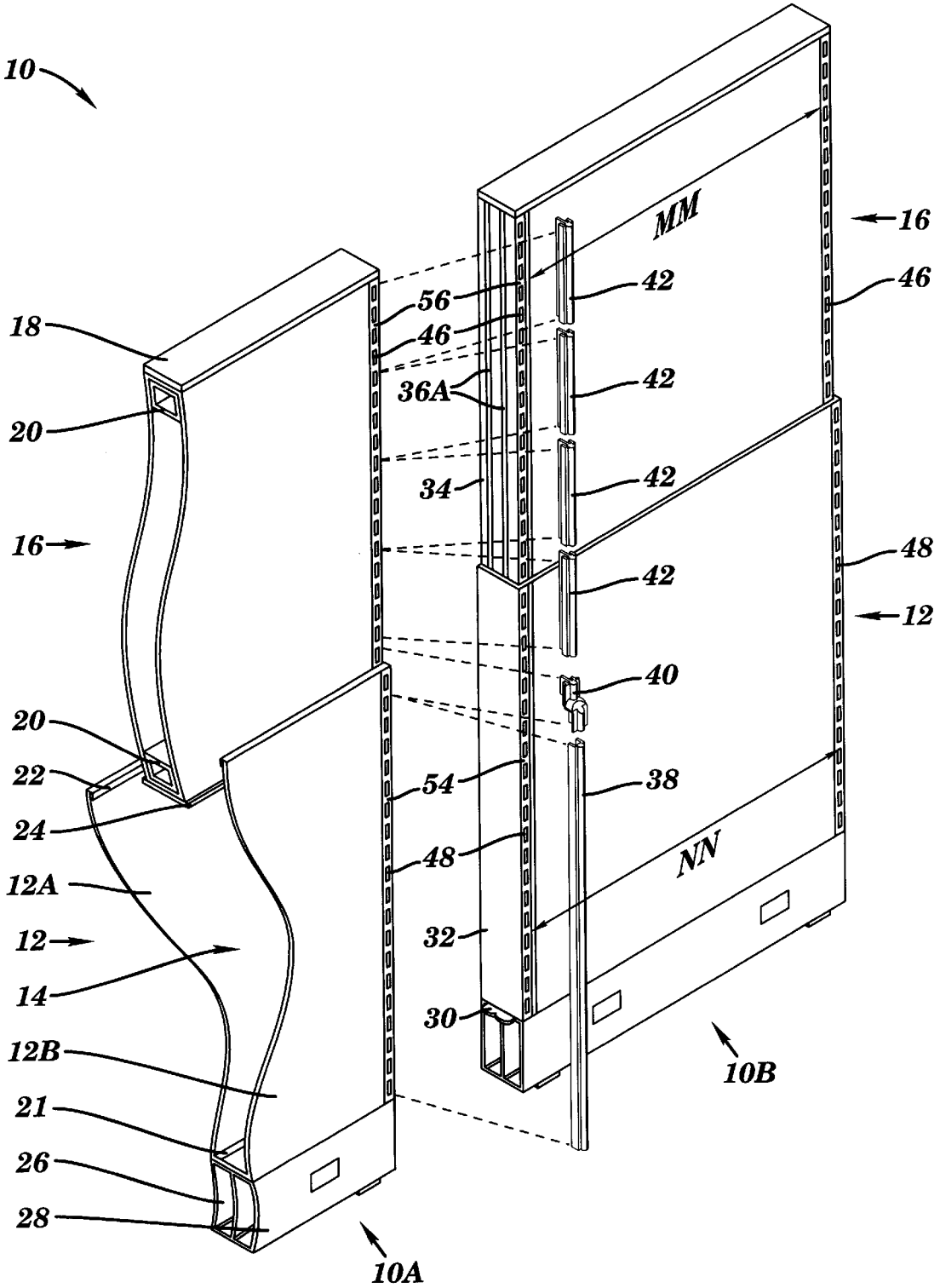
FIG. 2A illustrates a perspective view of a typical panel of the first embodiment in a fully extended upright position.
Figure 2B:
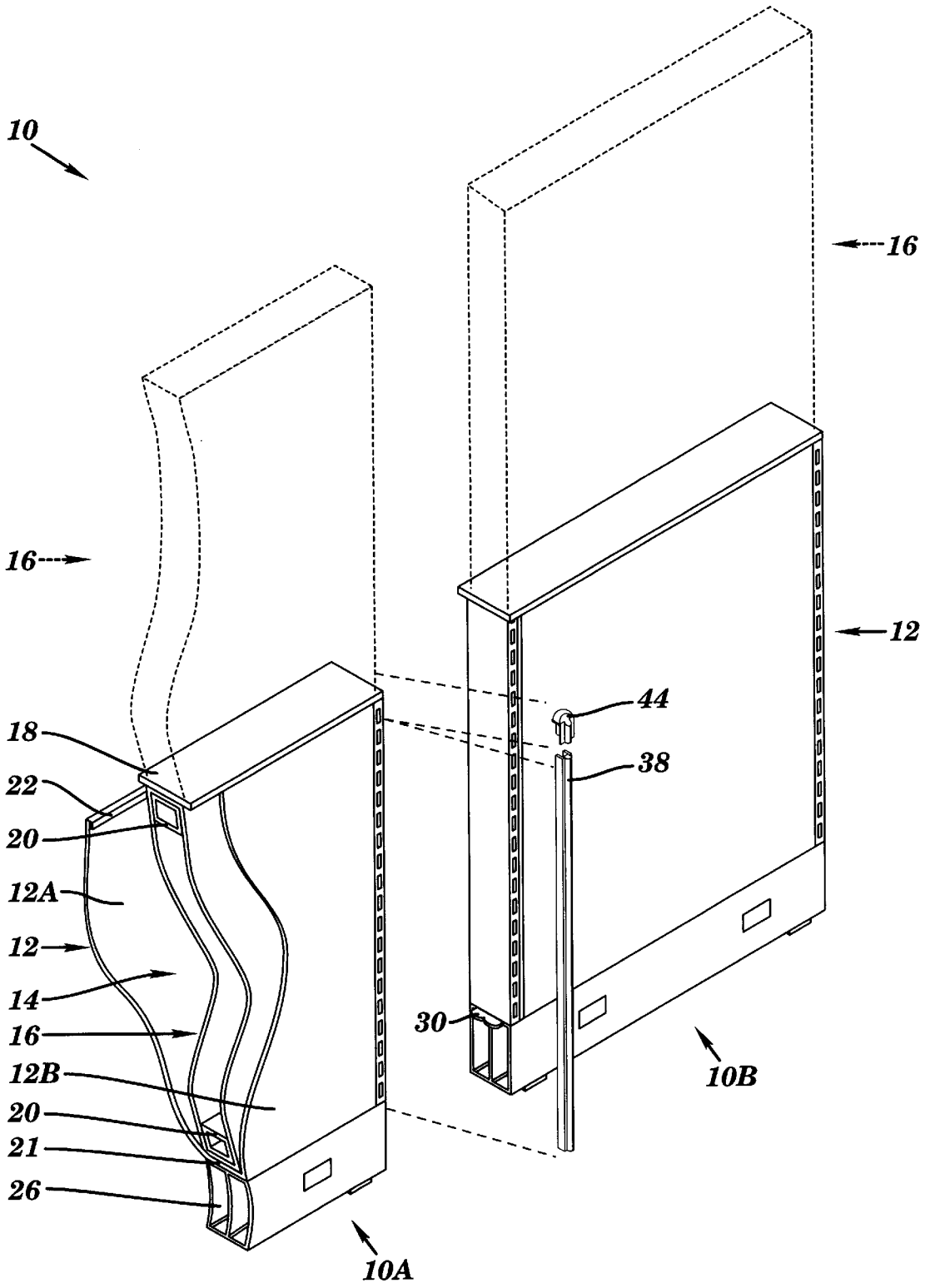
FIG. 2B illustrates a perspective view of a typical panel of the first embodiment in a fully lowered position.

FIGS. 2A and 2B illustrate a perspective view of a section of a typical panel unit system 10 in a fully extended upright position (FIG. 2A) and also in a completely lowered position (FIG. 2B). The panel units 10A and 10B are located side by side to form the panel unit system 10. (The individual panel unit will be referred to as a panel, partition, panel unit, or partition unit interchangeably throughout the description of the present invention). Only two panels, 10A and 10B, are shown here, but the system could include as many as are necessary to form a workstation, office space, or other type of enclosed area. Also, the panels could be strung together to form a whole series of workstations or enclosed areas. A plurality of the panel units may have a height to provide open visual communication and work-in-progress flow. Also, the workspace management system will allow a plurality of the panel units to have a height to provide both seated privacy and standing privacy.

A typical panel unit 1OA of the present invention operates by utilizing a vertically sliding upper panel portion 16 within a slightly larger base or lower panel portion 12. The upper panel portion may move from a first position located inside the lower panel portion 12 to a second position which is infinitely adjustable. The second position can range from approximately 1 inch above the lower panel portion 12 to a fully extended height of approximately 72 inches depending on the desired setting and the overall height of the panel. The upper panel portion 16 and the lower panel portion 12 are both fabric covered acoustical framed panels mounted on a rigid frame. The accoustical framed panels of the lower panel portion 12 form a first wall 12A and a second wall 12B. The upper panel portion 16 rests between the first wall 12A and second wall 12B when in the lower panel portion cavity or portion 14 when the upper panel portion 16 is fully lowered. The upper panel frame 20 provides structural integrity for the upper panel portion 16 and the lower panel frame 21 provides structural integrity for the lower panel portion 12. The frames may be constructed from a rigid structure such as welded steel. The lower panel portion 12 allows the upper panel portion 16 to vertically slide up and down in the lower panel portion cavity or opening 14. The width NN of the lower panel portion 12 is wider than the width MM of the upper panel portion 16 so that the upper panel portion 16 may slide into and out of the cavity 14 of the lower panel portion 12.

The upper panel portion 16 has a cap cover 18 which is removable and attaches to the upper panel portion frame 20. The cap cover 18 may be made from extruded aluminum. The cap cover 18 may act as a "handle" to raise and lower the upper panel portion 16 of the unit. The cap cover 18 has a rolled edge on each side to allow fingers to raise and lower the upper panel portion 16.

The frame strap 22 connects the lower panel portion 12 of the panel horizontally across each side. The frame strap 22 may be made from extruded steel. Panel stop 24, in conjunction with the frame strap 22, functions to prevent the upper panel portion 3 from extending too far vertically. The panel stop 24 may be made from a rigid material such as steel.

Figure 11:
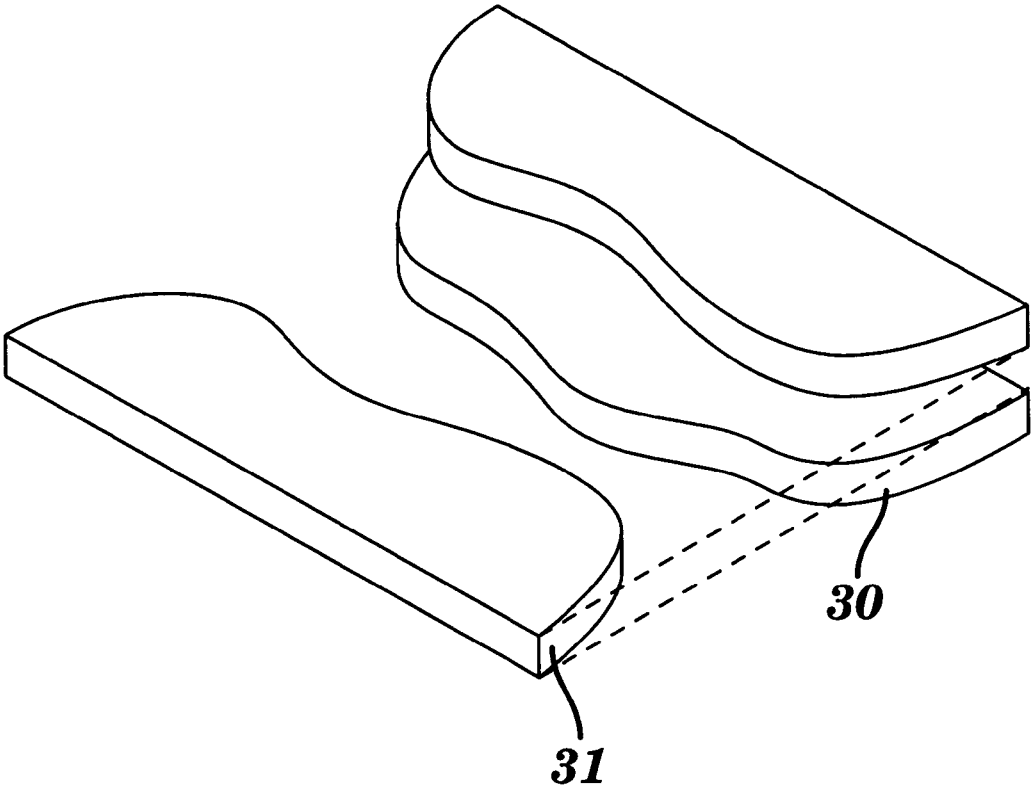
FIG. 11 illustrates a perspective view of the lower panel locking device.

The workstation system 10 further includes an electrical and communications welded steel raceway 26 with an aluminum raceway cover 28. A lower panel locking device 30 locks the lower panel portion 12 of the partition 10B into position with respect to a corresponding locking device (not shown) on partition 10A. The lower panel locking device 30 may be made of steel. FIG. 11 shows a perspective view of the lower panel locking device 30 connecting with the lower panel locking device 31 of a separate panel unit (not shown).

The height of the panels is adjusted using connectors 38, 40, and 42 in conjunction with a lower panel connector sleeve 54 and an upper panel connector sleeve 56 from each of the partitions 10A and 10B. The upper panel portion connectors 42 are supported by the transition connector 40 while the upper panel portion connectors 42 are engaged with or force fit into the upper panel connector sleeves 56 from each of the partitions 10A and 10B. When the upper panel portion 16 is completely lowered only the lower panel portion connector 38 is needed. In the completely lowered case, as shown in FIG. 2B, a special connector cap 44 may optionally be mounted on top of the lower panel portion connector 38. The lower panel portion connector 38 is engaged with or force fit into the lower panel portion connector sleeve 54. When the upper panel portion 16 is to be raised, upper panel portion connectors 42 and transition connector 40 are also used to hold the upper panel portion 16 in an extended position. Transition connector 40 is used at the junction of the upper panel portion 16 and the lower panel portion 12. The transition connector 40 helps to hold the upper portion connector 42 in place while resting on top of the lower portion connector 38. The transition connector 40 is supported by the lower panel portion connector 38 while it is engaged with both the upper panel portion connector sleeve 56 and the lower panel portion connector sleeve 54. The upper panel portion connectors 42 are engaged with or force fit into the upper panel portion in increments allowing the upper panel portion 16 to be raised or lowered to any height. The upper panel portion connectors 42 are inserted and stacked on top of each other to elevate the upper panel portion 16 in those increments. The upper panel connectors 42 are removed to lower the upper panel portion 16 in the same increments. The upper portion connectors 42 are inserted into the upper panel portion connector sleeves 56 in increments in the range of 2 to 48 inches with preferred dimensions of 5–6 inches. Further details of the height adjustment will be discussed below.

Figure 3:
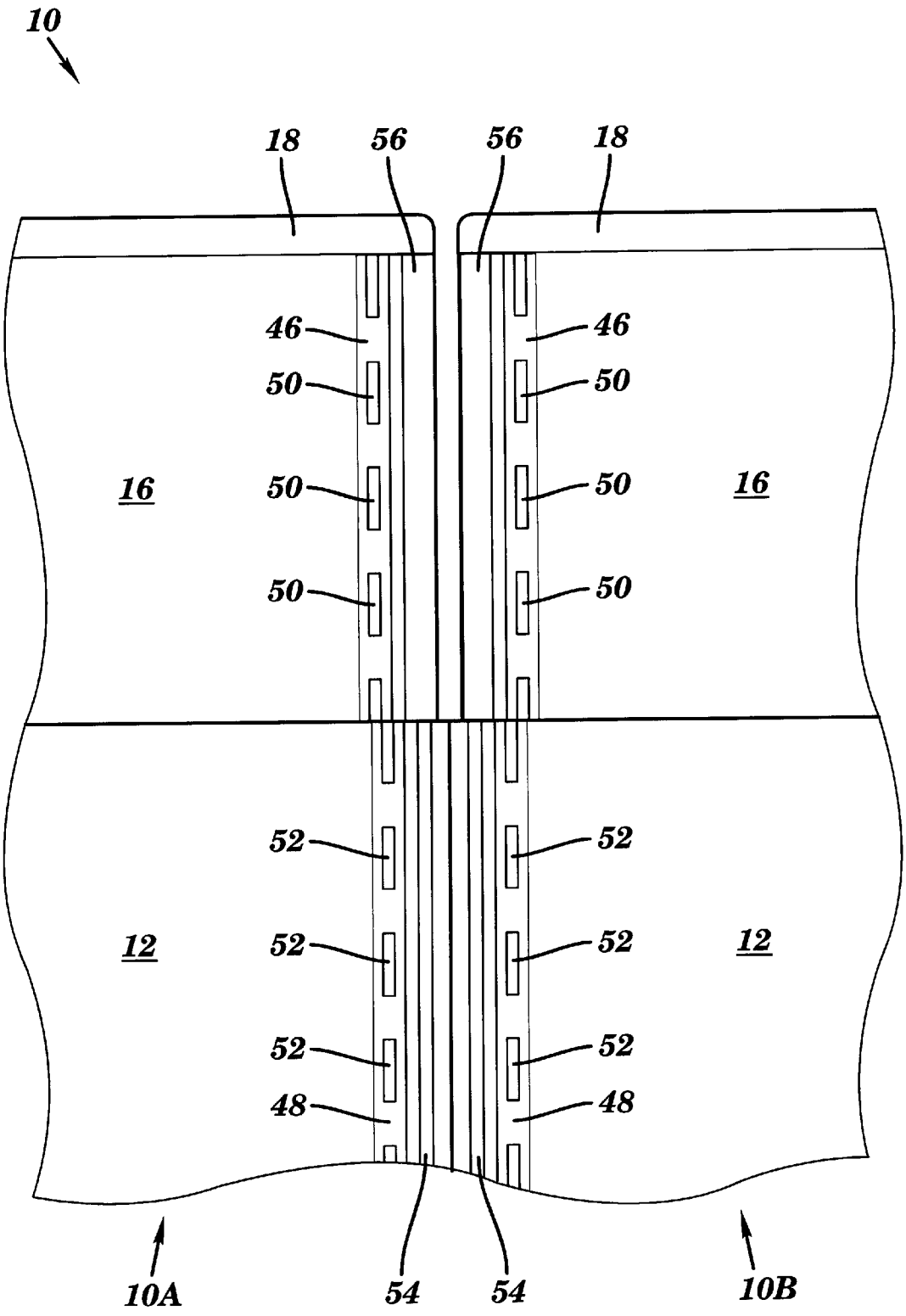
FIG. 3 shows a front view of two panels of the first embodiment side by side with no connectors attached.
Figure 18A:
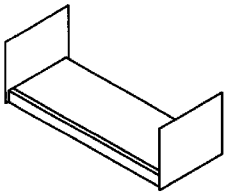
FIG. 18A–18S show a list of possible accessories which can be used with the present invention.
Figure 18B:
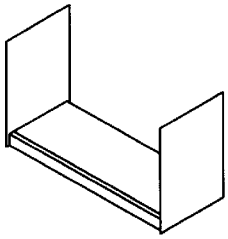
Figure 18C:
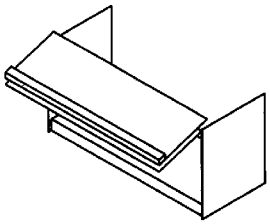
Figure 18D:
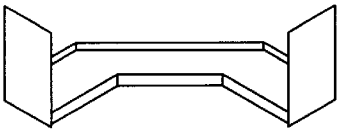
Figure 18E:
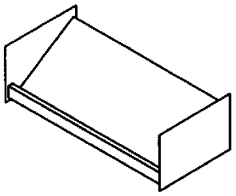
Figure 18F:
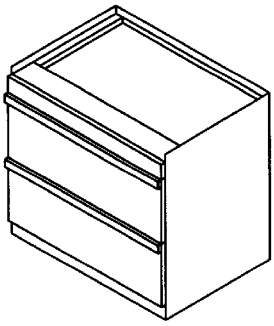
Figure 18G:
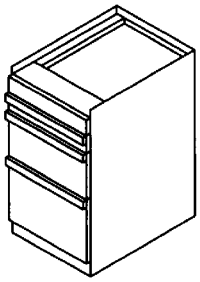
Figure 18H:
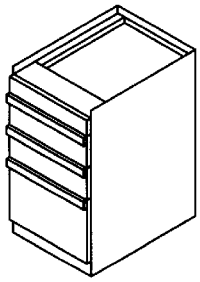
Figure 18I:
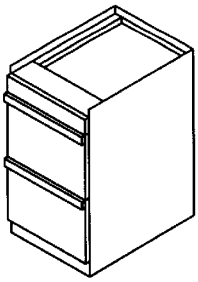
Figure 18J:
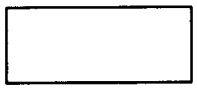
Figure 18O:
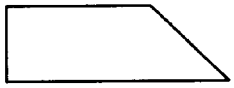
Figure 18K:
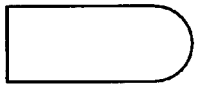
Figure 18P:
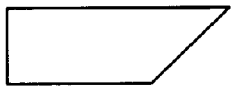
Figure 18L:
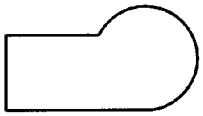
Figure 18Q:
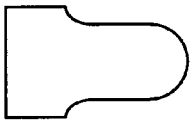
Figure 18M:
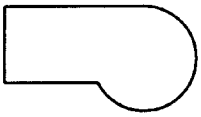
Figure 18R:
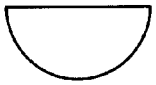
Figure 18N:
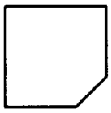
Figure 18S:
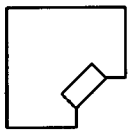

FIG. 3 shows a front view of two panels of the first embodiment side by side with the connectors 38, 40, and 42 removed. Upper panel portion rail 46 and lower panel portion rail 48 are used to mount accessories (not shown) on the panels. As shown in FIG. 2A, dimension MM is the spacing width between the upper panel portion rails 46 located on each side of the partition. Dimension NN is the spacing width between the lower panel portion rails 48. The spacing width MM is less than NN. Examples of the type of accessories which may be mounted are shown in FIGS. 18A–18S. The upper panel portion rail holes or slots 50 and the lower panel portion rail holes or slots 52 are used to hold the brackets (not shown) of the accessories. Although the spacing widths between the upper panel rail 46 and the lower panel rail 48 are not equal, brackets on the back of the accessories may be adjusted to compensate or correct for this. FIG. 3 also shows lower panel portion connectors sleeves 54 and upper panel portion connectors sleeves 56 which will be discussed in detail below.

Figure 4A:
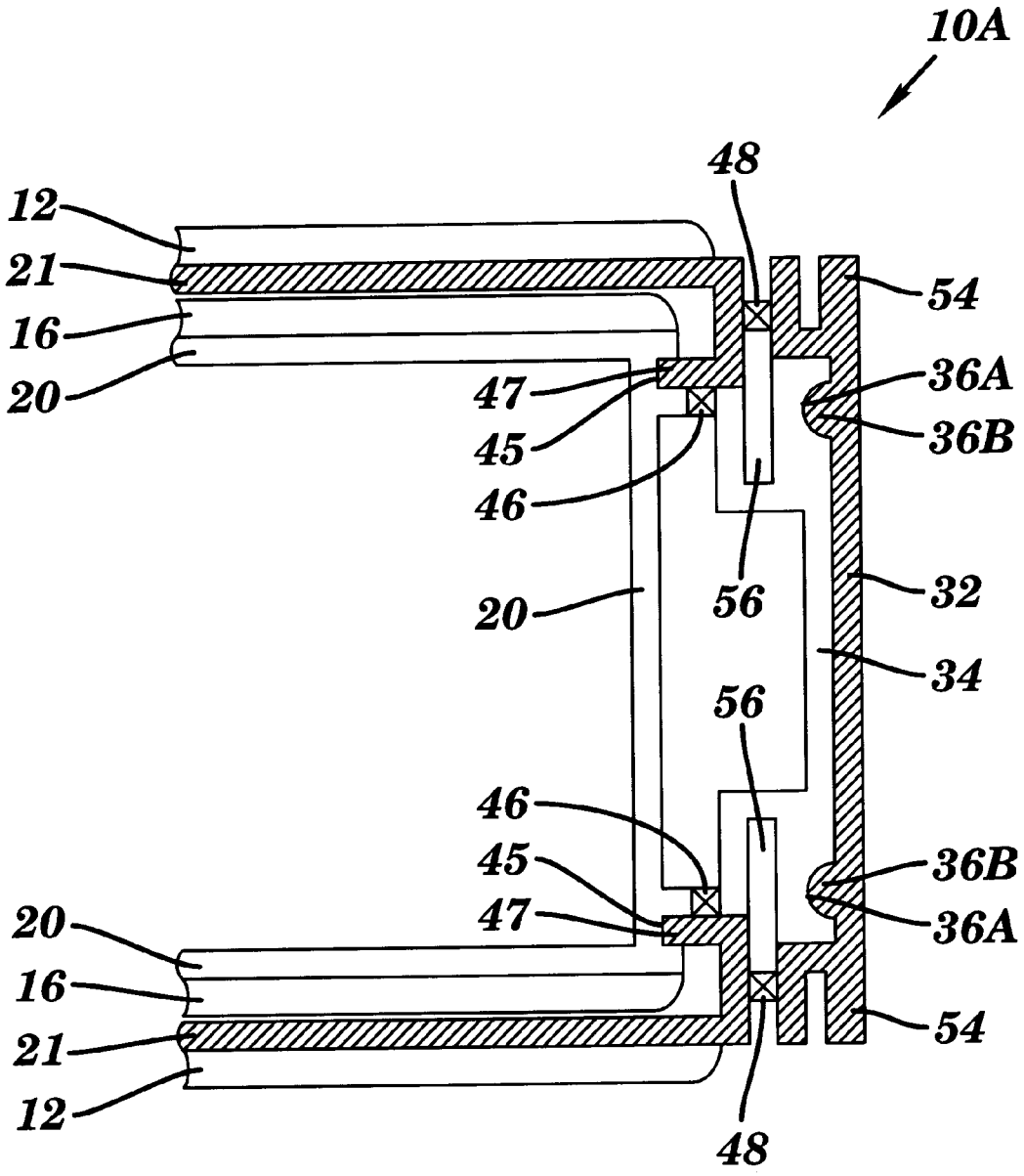
FIG. 4A shows a top view of a single panel of the first embodiment.

FIG. 4A shows a top view of a single panel 10A with the features associated with the upper panel portion 16 in white and the features associated with the lower panel portion 12 darkened. In FIG. 4A, the upper panel portion 16 is shown recessed into the lower panel portion 12 and the upper panel portion connectors 42, transition connectors 40, and lower panel portion connectors 38 are removed. The lower panel portion frame end 32 is attached to the lower panel portion frame 21 with the lower panel portion rail 48 located in between. The lower panel frame end 32 made be of a rigid material such as steel. The upper panel portion frame end 34 is attached to the upper panel portion frame 20. Items 36A are intregrally formed recessed grooves located on the upper panel portion frame end 34. Items 36B are corresponding raised portions integrally mounted on the lower panel portion frame end 32. The grooves 36A and raised portions 36B may be used to provide guidance to the upper panel portion as it is raised and lowered. The grooves 36A and raised portions 36B are optional and are not required. When the grooves 36A and raised portions 36B are used, the number is optional and may range from zero to ten with two being the ideal.

FIG. 4A further shows a rail section 47 of the lower panel portion frame 21 and a track section 45 of the upper panel portion frame 20. The rail section 47 and the track section 45 work contiguously to guide the upper panel portion 16 as it slides out of the lower panel portion 12. There are a total of four track sections 45 and rail sections 47 on each panel.

Figure 4B:
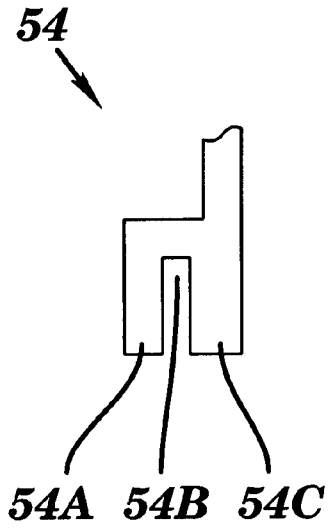
FIG. 4B shows a top view of a lower panel portion connector sleeve.
Figure 5A:
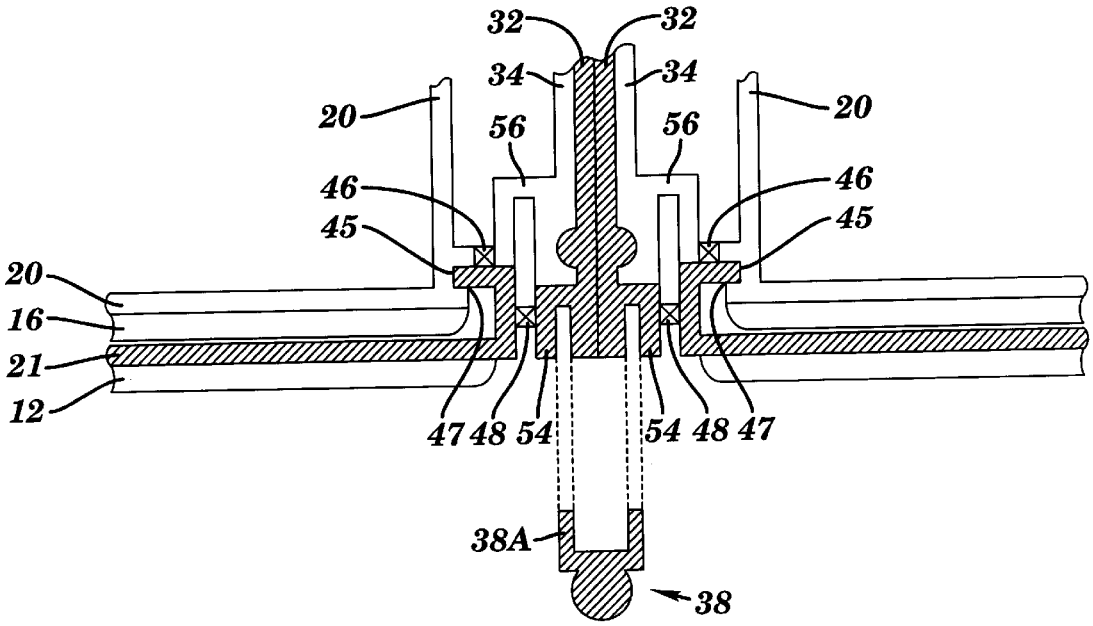
FIG. 5A shows a top view of the connection of two lower panels of the first embodiment using a lower panel connector.

Integrally formed with the lower panel portion frame end 32 are the lower panel portion connector sleeves 54. A lower panel portion connector sleeve 54 from each of the panels are pressed together by the lower panel portion connector 38 to lock the lower panel portions 12 together. This is shown in FIG. 5A. The lower panel portion connector sleeve 54 is shown in detail in FIG. 4B. The lower panel portion connector 54 includes a first projecting portion 54A, a connector channel 54B, and a second projecting portion 54C. The lower panel portion connector 38 is shown in detail in FIGS. 8A–8C. The lower panel portion connector 38 includes a grasping portion 38B and connection prongs 38A. The grasping portion 38B may be used to pull the lower panel portion connector 38 out of position and to force fit it into position. The connection prongs 38A are used to mate with the lower panel portion connector sleeve 54 as shown in FIG. 5A.

Figure 4C:
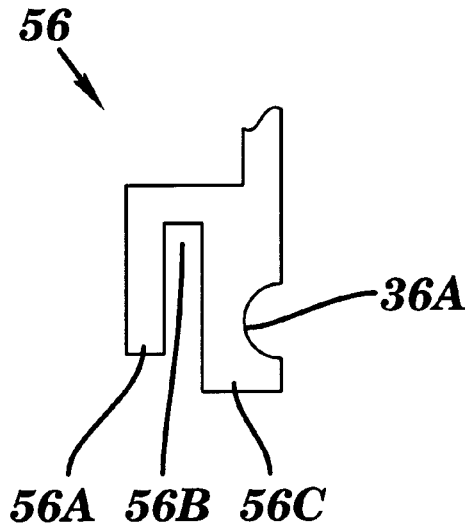
FIG. 4C shows a top view of an upper panel portion connector sleeve.
Figure 5B:
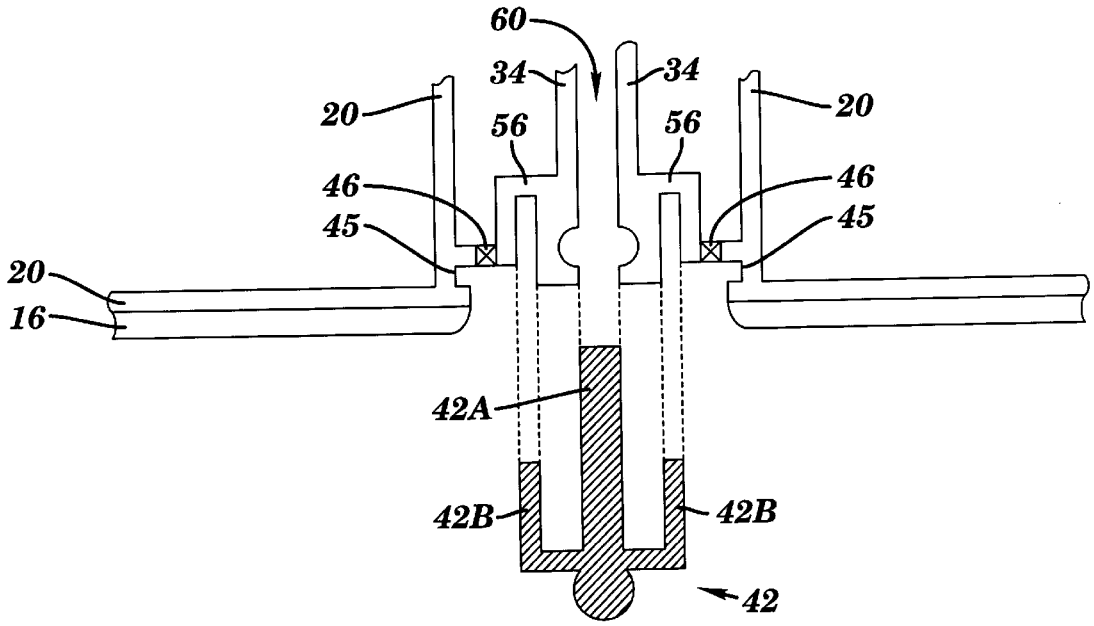
FIG. 5B shows a top view of the connection of two upper panels of the first embodiment in an extended position using an upper panel connector.

Integrally formed with the upper panel portion frame end 34 are the upper panel portion connector sleeves 56. An upper panel portion connector sleeve 56 from each of the panels are connected together by the upper panel portion connectors 42 as shown in FIG. 5B to lock the upper panel portions 16 together. The upper panel portion connector sleeve 56 is shown in detail in FIG. 4C. The upper panel portion connector sleeve 56 includes a first projecting portion 56A, a connector channel 56B, and a second projecting portion 56C. An upper panel portion connector 42 is shown in detail in FIGS. 7A–7C. An upper panel portion connector 42 includes a center connection prong 42A, two connections prongs 42B, and a grasping portion 42C. The grasping portion 42C may be used to pull the upper panel portion connector 42 out of position and to force fit it into position with an upper panel portion connector sleeve 56 mounted on the end of each of the panels as shown in FIG. 5B. FIG. 5B shows a top view of a raised upper panel portion 16. The center connection prong 42A and the two connection prongs 42B are used to mate with the upper panel portion connector sleeve 56. The center connection prong 42A fills in the gap or space 60 between two of the upper panel portions 16 of two panels which are attached. (Note that there is no gap between the lower panel portions 12 because the lower panel portion frame ends 32 are pressed up against each other. As a result, the shapes of the upper portion panel connectors 42 and the lower panel portion connectors 38 are different).

Figure 6:
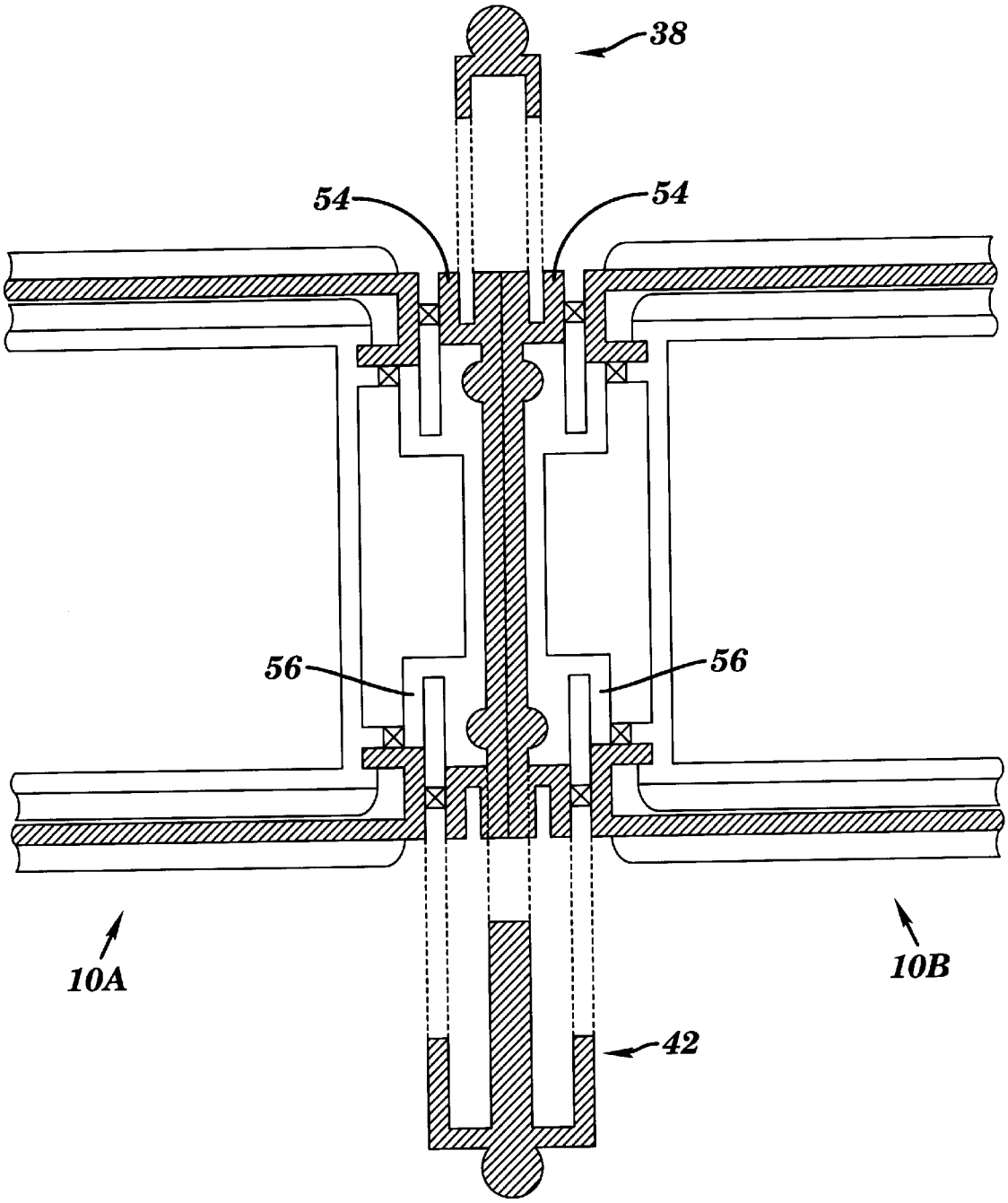
FIG. 6 shows a top view of the connection of two panels of the first embodiment with the lower panel connector and upper panel connector being attached.

FIG. 6 shows a top view of two panels 10A and 10B attached together and a lower panel portion connector 38 and an upper panel portion connector 42 being positioned. When the panel is in a raised position and locked into place, there will be two lower panel portion connectors 38 mounted oppositely on each side of the junction of two panels, two transistion connector 40 mounted oppositely on each side of the junction of the two panels, and a plurality of upper panel portion connectors 42 mounted on each side of the junction of the two panels.

Figure 7A:
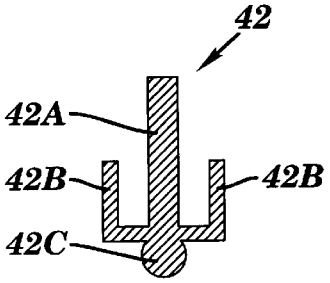
FIG. 7A shows a top view of an upper panel connector of the first embodiment.
Figure 8A:
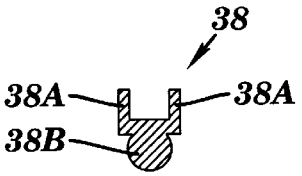
FIG. 8A shows a top view of a lower panel connector of the first embodiment.
Figure 7B:
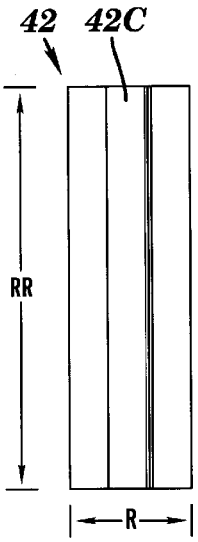
FIG. 7B shows a front view of an upper panel connector of the first embodiment.
Figure 7C:
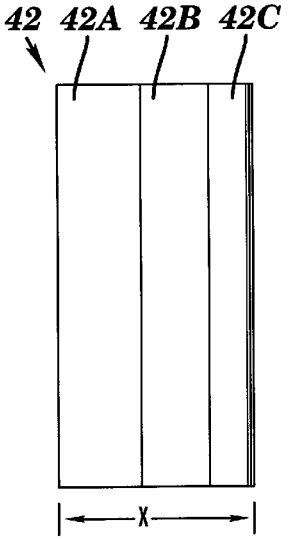
FIG. 7C shows a side view of an upper panel connector of the first embodiment.
Figure 8B:
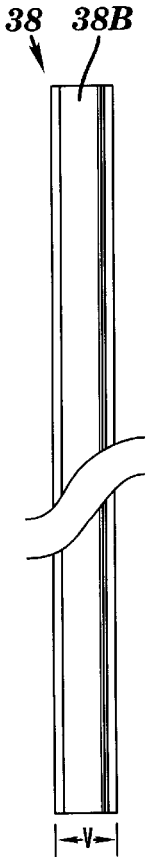
FIG. 8B shows a front view of a lower panel connector of the first embodiment.
Figure 8C:
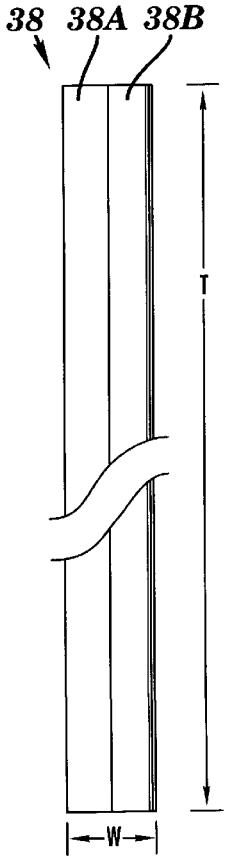
FIG. 8C shows a side view of a lower panel connector of the first embodiment.
Figure 9:
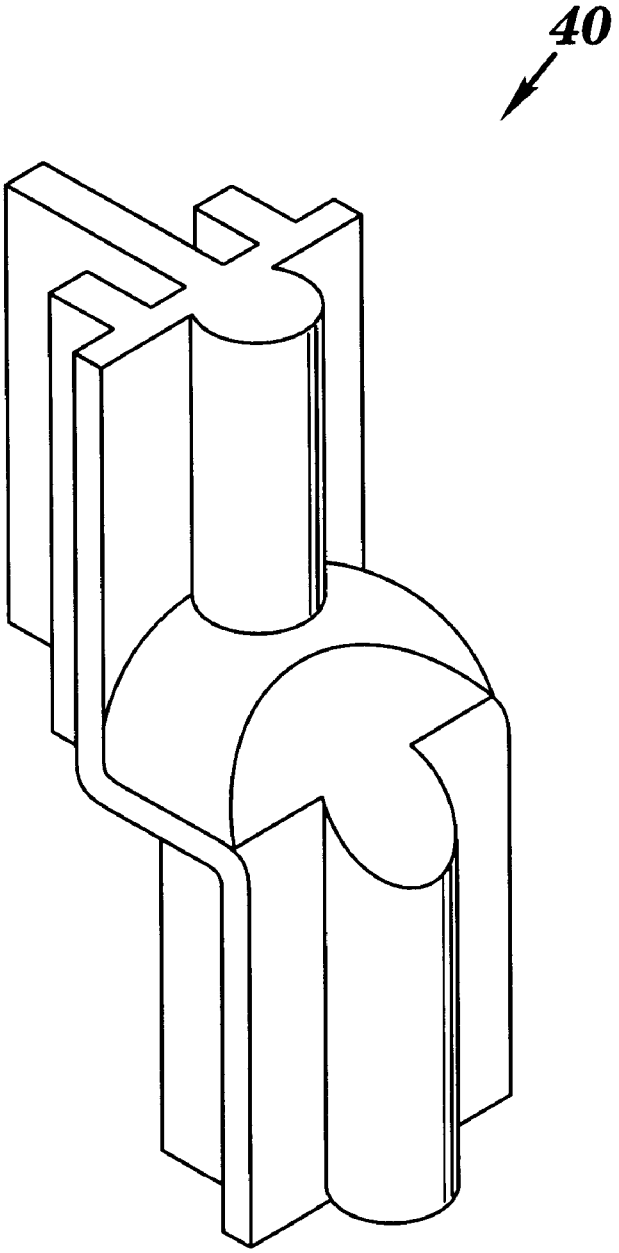
FIG. 9 shows a perspective view of a transition connector of the first embodiment.

FIGS. 7A–7C show the dimensions of the upper panel portion connectors 42. FIG. 7A is a top view, FIG. 7B is a front view, and FIG. 7C is a side view. As stated above, a plurality of upper portion connectors 42 are inserted into the upper panel portion connector sleeves 56 in increments of dimension RR in the range of approximately 2 to 48 inches with preferred dimensions in the range of approximately 5–6 inches. The dimension R is approximately one inch and the dimension X is approximately 1.5 inches. The central prong 42A will be long enough to touch the central prong of the other upper panel portion connector 42 in the center of the space 60 in FIG. 5B. FIGS. 8A–8C show the dimensions lower panel portion connectors 38. FIG. 8A is a top view, FIG. 8B is a front view, and FIG. 8C is a side view. Dimension V is approximately 1.5 inches. Dimension W is approximately 0.75 inches. Dimension T, the length of the lower panel portion connector 38, may range from approximately 29 inches to 43 inches depending on the overall height of the panel 10A. For an overall panel height of 60 inches, T would be approximately 29 inches.

Figure 10A:
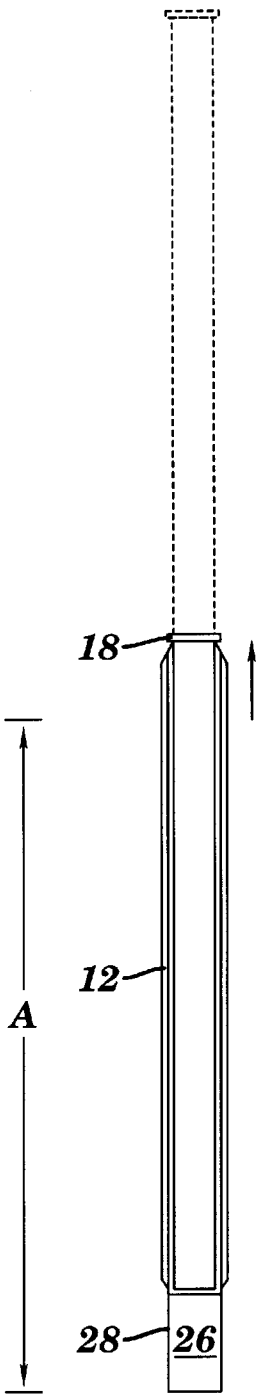
FIG. 10A shows a side view of a panel of the first embodiment fully lowered.
Figure 10B:
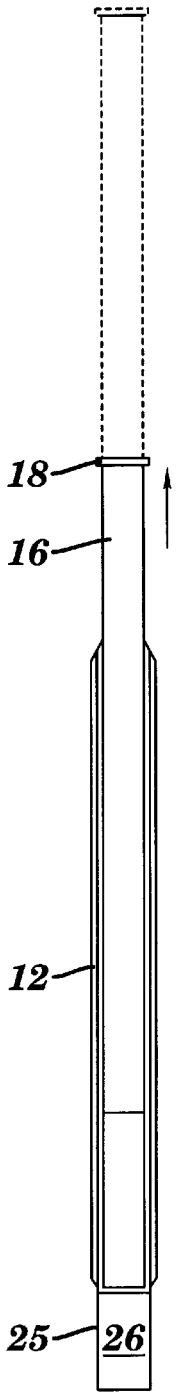
FIG. 10B shows a side view of a panel of the first embodiment partially lowered.
Figure 10C:
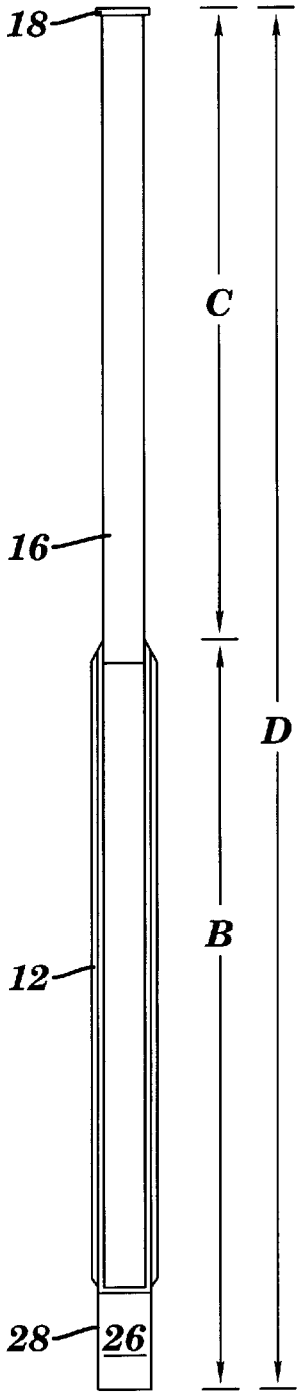
FIG. 10C shows a side view of a panel of the first embodiment fully extended.
Figure 10D:
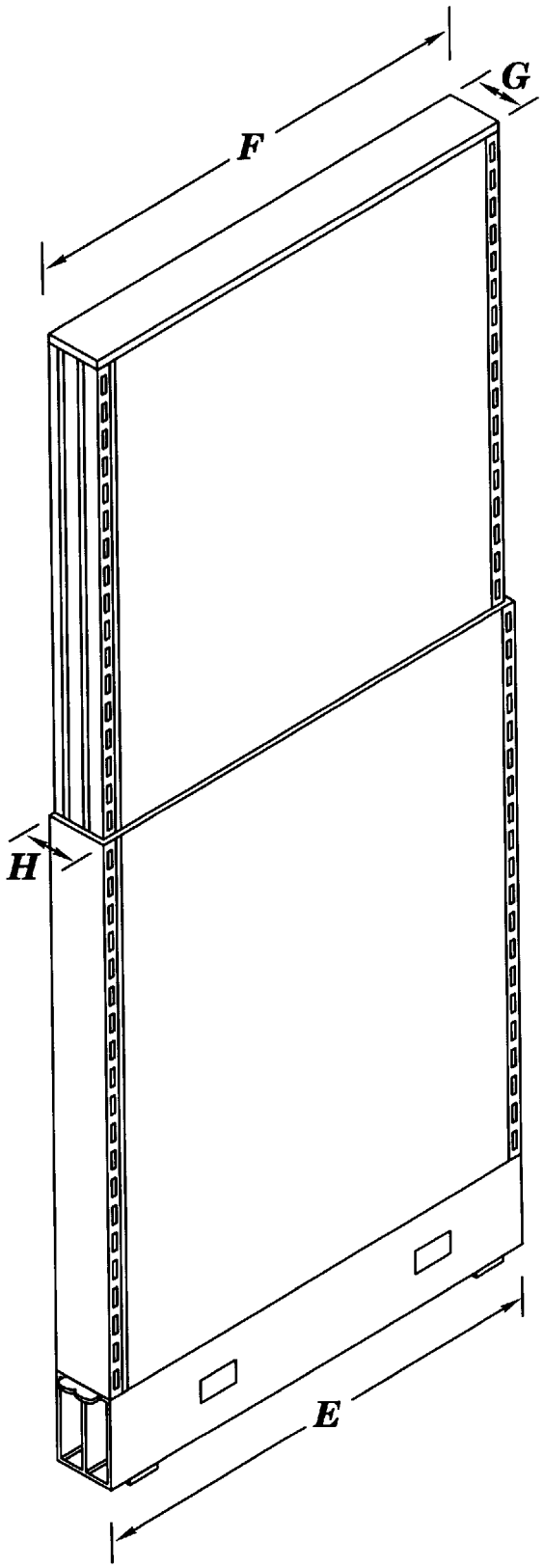
FIG. 10D shows a perspective view of a panel of the first embodiment fully extended.

FIG. 10A shows a side view of a panel in a recessed position, FIG. 10B shows a side view of the panel with an upper panel portion 16 in a partially raised position, FIG. 10C shows a side view of the panel with an upper panel portion 16 in a fully extended position, and FIG. 10D shows a perspective view of the panel with the upper panel portion 16 in a fully extended position. In FIG. 10A, dimension A shows the height of a work surface in relation to a panel with a lower panel portion height B and upper panel portion height C to rise to a total expanded height of D. Dimension A is typically equal to approximately 29 inches. Dimension B, the lower panel portion height, may range from approximately 32 inches to 43 inches. If dimension B is equal to approximately 32 inches, then dimension C would be 28 inches, and the overall height dimension D would be 60 inches. (Note that the present invention can be used with or without the raceway 26 which would effect the above dimensions). Other standard dimensions of dimension B that are used include approximately 39 inches, 42 inches, 48 inches, and 60 inches. Dimension C, in these cases, would be substantially the same height of dimension B minus the height of the raceway 26. FIG. 10D discloses the widths of a typical panel. Dimension E, which is the dimension of the lower panel portion or base, may range anywhere from approximately 12 inches to 72 inches. Typically, this dimension will be in the 24 inches to 60 inches range. The upper panel portion dimension F may correspondingly range anywhere from 11 inches to 71 inches. The upper panel portion dimension F will always be slightly less than dimension E. The thickness dimension H of the lower panel portion will range from 4 inches to 12 inches and the thickness dimension G of the upper panel portion will be slightly less and range from 3.5 inches to 11.5 inches.

Figure 12A:
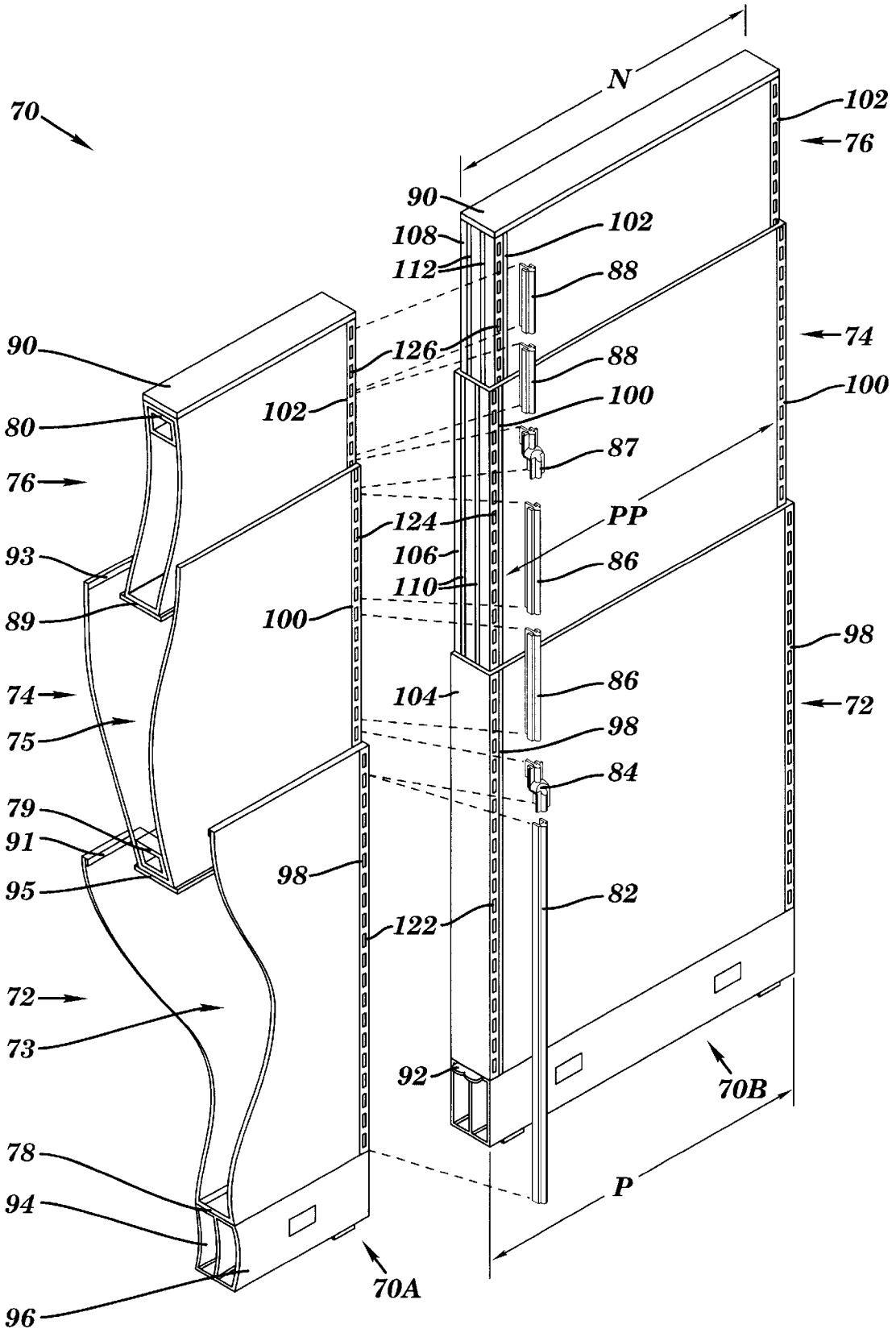
FIG. 12A illustrates a perspective view of a typical panel of a second embodiment of the present invention in a fully extended upright position.
Figure 12B:
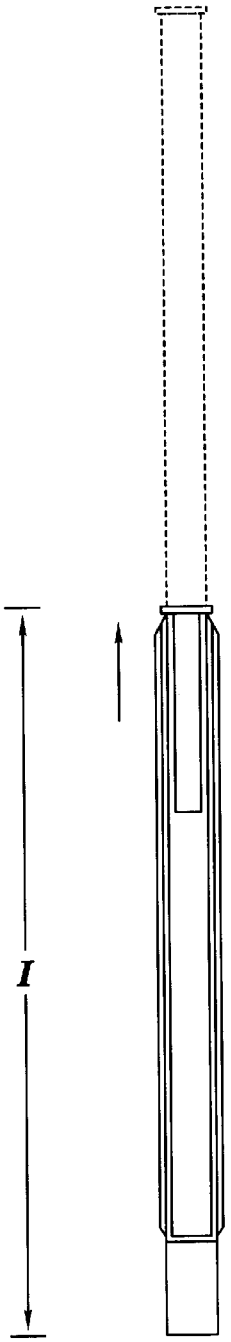
FIG. 12B shows a side view of a panel of the second embodiment fully lowered.
Figure 12C:
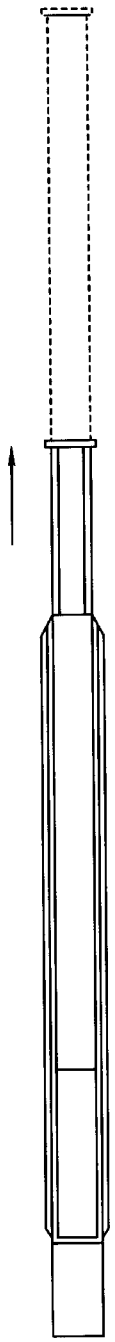
FIG. 12C shows a side view of a panel of the second embodiment partially extended.
Figure 12D:
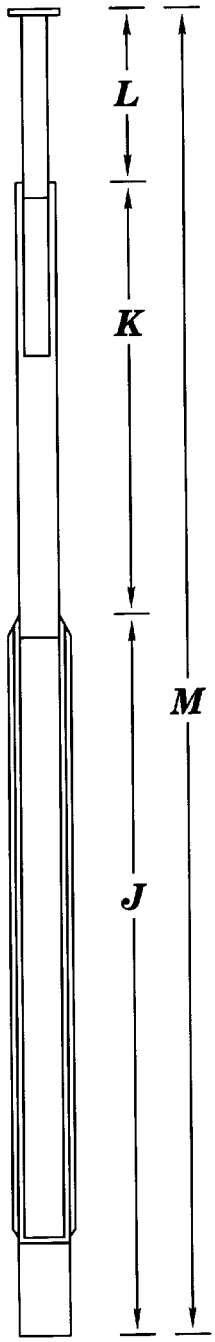
FIG. 12D shows a side view of a panel of the second embodiment fully extended.

FIG. 12A shows a second embodiment of the present invention. FIG. 12A discloses a bottom partition portion 72, a middle partition portion 74, and a top partition portion 76. The second embodiment has all the flexibility of the first embodiment, but it also allows the partition to be lowered to an overall height of 29 inches which is a common work surface height. This feature allows the user to set the partition at the same height as work surfaces on either side of the partition when the partition is in its lowest position. The user will be able to have a flat, continuous surface between two worksurfaces on either side of the partition. The second embodiment also allows a plurality of said panel units to have a height to provide open visual communication and work-in-progress flow.

FIG. 12A shows a perspective view of the typical section of a panel unit system 70 in a fully extended upright position. The second embodiment functions in many ways the same as the first embodiment. The panel units 70A and 70B are located side by side to form the panel unit system 70. Only two panels, 70A and 70B, are shown here, but the system could include as many as are necessary to form a workstation, office space, or other type of enclosed area. Also, the panels could be strung to together to form a whole series of workstations or enclosed areas.

A typical panel unit 70A of the second embodiment operates by utilizing a vertically sliding top panel portion 76 within a slightly larger middle panel portion 74. The middle panel portion 74 operates by vertically sliding into an even slightly larger bottom panel portion 72. The top panel portion 76, middle panel portion 74, and bottom panel portion 72 are also fabric covered accoustical framed panels mounted on a rigid frame. The top panel frame 89 provides structural integrity for the top panel portion 76, the middle panel frame 79 provides structural integrity for the middle panel portion 74, and the bottom panel frame 78 provides structural integrity for the bottom panel portion 72. The frames may be constructed from a rigid structure such as welded steel. The middle panel portion 74 allows the top panel portion 76 to vertically slide up and down into the middle panel portion cavity or opening 75. The bottom panel portion 72 allows the middle panel portion 74 (which contains the top panel portion 76) to vertically slide up and down into the bottom panel portion cavity or opening 73. The width of the middle panel portion 74 is slightly wider than the width of the top panel portion 76 so that the top panel portion 76 may slide into and out of the middle panel portion cavity 75. The width of the bottom panel portion 72 is slightly wider than the width of the middle panel portion 74 so that the middle panel portion 74 may slide into and out of the middle panel portion cavity 73.

The top panel portion 76 has cap cover 90 which is removable and attaches to the top panel portion frame 80. The cap cover 90 may be made from extruded aluminum. The cap cover 90 may act as a "handle" to raise and lower the top panel portion 76 of the panel unit 70A. The cap cover 90 has a rolled edge on each side to allow fingers to raise and lower the top panel portion 76. When the top panel portion 76 is lifted, it rises until it hits the middle panel portion frame strap 93 with the top panel portion stop 89. The middle panel portion frame strap 93 connects the middle panel portion 74 of the panel horizontally across each side. The top panel portion stop 89, in conjunction with the middle panel portion frame strap 93, functions to prevent the top panel portion 76 from extending too far vertically. When the top panel portion stop 89 hits the middle panel portion frame strap 93, it begins to lift the middle panel portion 74 out of the bottom panel portion cavity 73. The middle panel portion 74 rises until it hits the bottom panel portion frame strap 91 with the middle panel portion stop 95. The bottom panel portion frame strap 91 connects the bottom panel portion 72 of the panel horizontally across each side. The middle panel portion stop 95, in conjunction with the bottom panel portion frame strap 91, functions to prevent the middle panel portion 74 from extending too far vertically. Both the top panel portion stop 89 and the middle panel portion stop 95 may be made from a rigid material such as steel.

The workstation system 70 further includes an electrical and communications raceway 94, which may be made from welded steel, and a raceway cover 96, which may be made from aluminum. A bottom panel locking device 92 locks the bottom panel portion 72 of the partition 70B into position with respect to a corresponding locking device (not shown) on partition 70A.

The height of the panels are adjusted in the same manner as the first embodiment using the same type of connectors and connector sleeves. The height of the panels are adjusted using connectors 82, 84, 86, 87, and 88 in conjunction with bottom panel connector sleeve 122, middle panel portion connector sleeve 124, and top panel portion connector sleeve 126 from each of the partitions 70A and 70B. The top panel portion connectors 88 are supported by the middle panel portion transition connector 87 while the top panel portion connectors 88 are engaged with or force fit into the top panel portion connector sleeve 126 from each of the partitions 70A and 70B. The middle panel portion connectors 86 support the middle panel portion transition connector 87. The middle panel portion connectors 86 are supported by the bottom panel transition connector 84 while the middle panel portion connectors 86 are engaged with or force fit into the middle panel portion connector sleeve 124. The bottom panel portion connector 82 supports the bottom panel portion transistion connector 84. When both the top panel portion 76 and the middle panel portion 74 are completely lowered only the bottom panel portion connector 82 is needed.

The plurality of middle panel portion connectors 86 and top panel portion connectors 88 allow the middle panel portion 74 and the top panel portion 76 to be set to any height. The middle panel portion connectors 86 and top panel portion connectors 88 are inserted and removed in increments to set the overall height of the panel 70A. The top portion panel connectors 88 are inserted into the top panel portion connector sleeves 126 in increments ranging from 2 to 24 inches with preferred dimensions of 3 to 6 inches. The middle portion panel connectors 86 are inserted into the middle panel portion connector sleeves 124 in increments ranging from 2 to 36 inches with preferred dimensions of 3 to 6 inches.

The second embodiment uses a track and rail systems similar to the first embodiment (which was described with respect to FIG. 4A) to guide the top panel portions and middle panel portions from the lowered position (first position) to an extended position (second position). The panel units would each have four track and rail systems to guide the top panel portion 76 and four track and rail systems to guide the middle panel portion 74. The top panel frame end 108 may have recessed portions 112 and the middle panel frame end 106 may have recessed portions 110 to guide the top panel portion 76 and middle panel portion 74.

Figure 13:
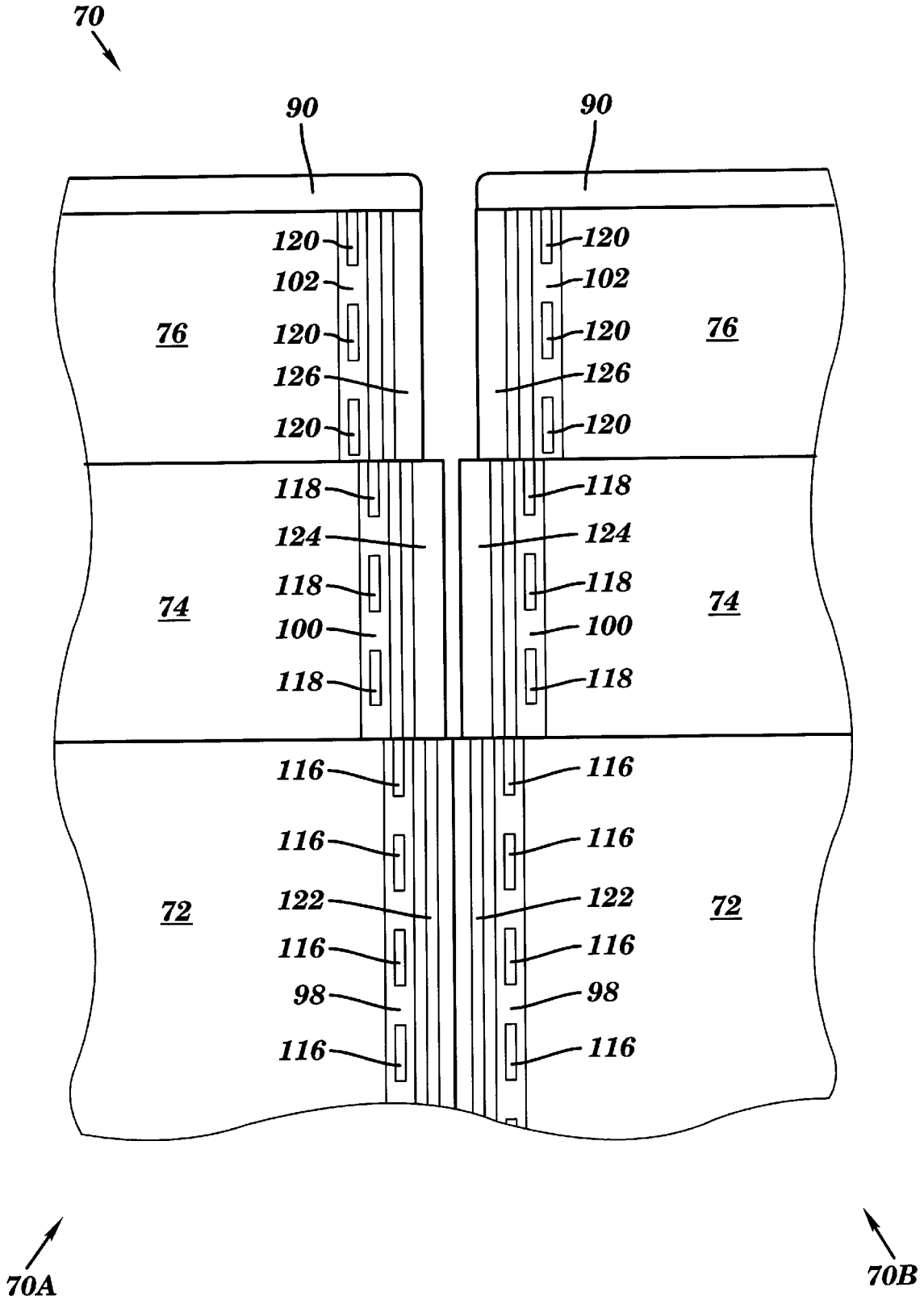
FIG. 13 illustrates a front view of two panels of the second embodiment side by side with no connectors attached.

FIG. 13 shows a front view of two panels (70A, 70B) of the second embodiment side by side with the connectors removed. Top panel portion rail 102, middle panel portion rail 100, and bottom panel portion rail 98 are used to mount accessories (not shown) on the panels 70A, 70B.
Examples of the type of accessories which may be mounted are shown in FIGS. 18A–18S. The top panel portion rail holes or slots 120, the middle panel portion rail holes or slots 118, and the bottom panel portion rail holes or slots 116 are used to hold the brackets (not shown) of the accessories. Although the spacing between the top panel portion rail 102, middle panel portion rail 100, and bottom panel portion rail 98 are not equal, brackets on the back of the accessories may be adjusted to compensate or correct for this.

FIGS. 14A–14C show the dimensions of the top panel portion connectors 88. FIG. 14A is a top view, FIG. 14B is a front view, and FIG. 14C is a side view. A plurality of top panel portion connectors 88 are inserted into the top panel portion connector sleeves 126 in increments of dimension AA in the range of approximately 2 to 36 inches with preferred dimensions in the range of 3 to 6 inches. The dimension BB is approximately 2 inches, and the dimension CC is approximately 1.5 inches. The central prong 88A will be long enough to touch the corresponding central prong 88A of the top panel portion connector 88 mounted on the opposite side of the panel. FIGS. 15A–15C shows the dimensions of the middle panel portion connectors 86. FIG. 15A is a top view, FIG. 15B is a front view, and FIG. 15C is a side view. A plurality of middle panel portion connectors 86 are inserted into the middle panel portion connector sleeves 124 in the range of approximatley 2 to 36 inches with dimensions in the range of approximately 3 to 6 inches. Dimension EE is approximately 1 inch and dimension FF is approximately 1.5 inches. The central prong 86A will be long enough to touch the corresponding central prong 86A of the middle panel portion connector mounted on the opposite side of the pane. FIGS. 16A–16C show the dimensions of the bottom panel portion connectors 82. FIG. 16A is a top view, FIG. 16B is a front view, and FIG. 16C is a side view. Dimension JJ, the length of the bottom panel portion connector 82, may range from approximately 29 inches to 43 inches depending on the overall height of the panel. For an overall panel height of 60 inches, JJ would be approximately 29 inches. Dimension GG is approximately 1.5 inches. Dimension HH is approximately 0.75 inches.

Figure 17A:
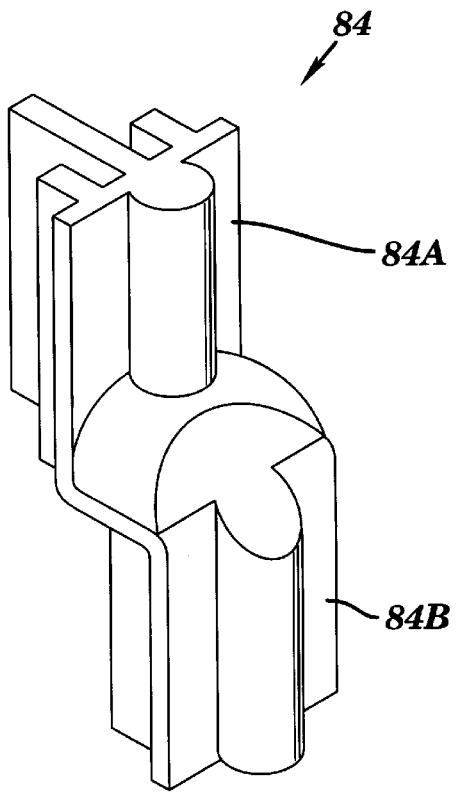
FIG. 17A shows a perspective view of a lower panel transition connector.
Figure 17B:
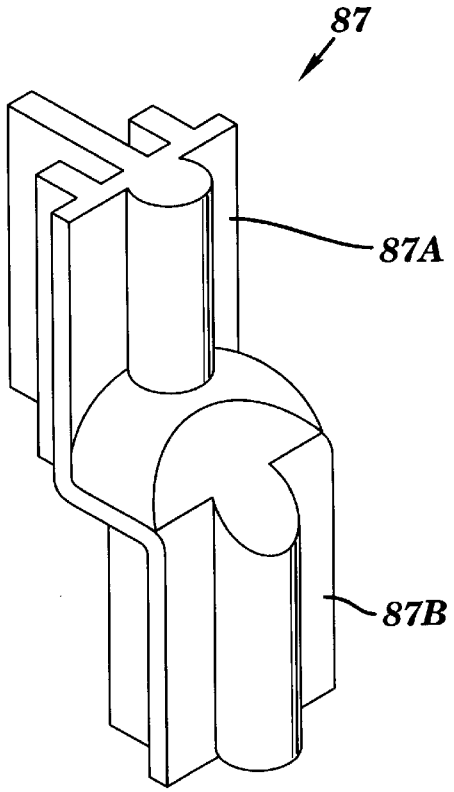
FIG. 17B shows a perspective view of a middle panel transition connector.

FIG. 17A shows a perspective view of bottom panel portion transition connector 84. The top region 84A of the bottom panel portion transition connector 84 supports the middle panel portion connectors 86 and the bottom region 84B of the bottom panel portion transition connector 84 rests on the bottom panel portion connector 82. FIG. 17B shows a perspective view of middle panel portion transition connector 87. The top region 87A of the middle panel portion transition connector 87 supports the top panel portion connectors 88 and the bottom region 87B rests on the middle panel portion connectors 86.

FIGS. 18A–18S shows possible accessories which may be used with the present invention. FIG. 18A shows a low shelf. FIG. 18B shows a high shelf. FIG. 18C shows an enclosed shelf. FIG. 18D shows a comer shelf. FIG. 18E shows slanted shelf. FIG. 18F shows a lateral file. FIG. 18G shows a pencil/box/file pedestal. FIG. 18H shows a box/box/file pedestal. FIG. 181 shows a file/file pedestal. FIG. 18J shows a straight worksurface. FIG. 18K shows a built worksurface. FIG. 18L shows a right conference worksurface. FIG. 18M shows a left conference worksurface. FIG. 18N shows a corner worksurface. FIG. 180 shows a right forty five worksurface. FIG. 18P shows a left forty five worksurface. FIG. 18Q shows a network worksurface. FIG. 18R shows a conference end worksurface. FIG. 18S shows a keyboard corner worksurface. The listed accessories are only a partially list and should be regarded as illustrative rather than limitative.

The advantages of the present invention include saving time, saving money, and having less inventory.

Although the present invention has been described above in specific terms, the description should be regarded as illustrative rather than limitative. Thus, workers of ordinary skill in the art will appreciate that the invention may be otherwise practiced, but that such alternative modes are encompassed by the terms of the following claims and equivalents thereto.

While the invention has been described in terms of its preferred embodiments, those skilled in the art will recognize that the invention can be practiced with modification within the spirit and scope of the appended claims.

What is claimed is:

1. An apparatus comprising:

a first panel portion having a first wall and a second wall;

a second panel portion located between the first wall and second wall wherein, said second panel portion is slidably adjustable between a first position and a second position; and a plurality of incrementally adjustable connectors that support the second panel in the second position.

2. The apparatus of claim 1, wherein the second position is located above the first position.

3. The apparatus of claim 1, further comprising:

a plurality of rail sections and track sections which guide the second panel portion between the first position and second position.

4. The apparatus of claim 1, wherein the plurality of connectors are supported by a transition connector.

5. The apparatus of claim 1, wherein the plurality of connectors are engaged with a connector sleeve.

6. The apparatus of claim 1, wherein the second panel is adjustable in the vertical direction.

7. The apparatus of claim 6, wherein the second position is located in a range of approximately 1 to 43 inches above the first position.

8. The apparatus of claim 6, wherein the second position is located in the range of approximately 1 to 28 inches above the first position.

9. The apparatus of claim 6, wherein the second position is located approximately 28 inches above the first position.

10. An apparatus comprising:

a lower panel portion having a first wall and a second wall;

an upper panel portion located between the first wall and the second wall; and an adjusting means for slidably adjusting the upper panel portion between a first position and a second position wherein the adiusting means includes:

a plurality of upper panel portion connectors to support the upper panel portion in the second position, a transition connector to support the upper panel portion connector, and a lower panel portion connector to support the transition connector.

11. The apparatus of claim 10, further comprising:

lower panel rails located on the lower panel portion;

upper panel rails located on the upper panel portion; and wherein the lower panel rails and the upper panel rails are spaced different distances.

12. The apparatus of claim 10, wherein the adjusting means further comprises:

a rail and track section to guide the upper panel portion.

13. The apparatus of claim 10, wherein the adjusting means further comprises:

an upper panel portion connector sleeve to engage the plurality of upper panel portion connectors and the transition connector; and a lower panel portion connector sleeve to engage the transition connector and the lower panel portion connector.

14. A workspace management system for dividing a room into separate work areas comprising:

a plurality of panel units rigidly joined together at the edges to form at least one work area;

each of said plurality of panel units comprising:

a lower panel portion;

an upper panel portion located within the lower panel portion;

said upper panel portion being slidably positionable between a first position and a second position;

a plurality of upper panel portion connectors which support the upper panel portion in the second position;

a transition connector supporting the plurality of upper panel portion connectors and being supported by a lower panel portion connector;

upper panel rails located on an upper panel portion for supporting accessories;

lower panel rails located on a lower panel portion for supporting accessories;

wherein the lower panel rails and upper panel rails are spaced different distances; and a plurality of rail sections and track sections which guide the upper panel portion between the first position and the second position.

15. A partition comprising:

a lower panel portion;

an upper panel portion located within the lower panel portion;

said upper panel portion being slidably positionable between a first position and a second position;

a plurality of upper panel portion connectors which support the upper panel portion in the second position;

a transition connector supporting the plurality of upper panel portion connectors and being supported by a lower panel portion connector;

upper panel rails located on an upper panel portion for supporting accessories;

lower panel rails located on a lower panel portion for supporting accessories;

wherein the lower panel rails and upper panel rails are spaced different distances;

a plurality of rail sections and track sections which guide the upper panel portion between the first position and the second position.

16. A method of changing the height of a panel in a workspace management system from a lowered position to an extended position comprising:

lifting the panel;

inserting a lower panel portion connector into a lower panel portion connector sleeve;

inserting a transition connector into the lower panel portion connector sleeve and an upper panel portion connector sleeve;

inserting a plurality of upper panel portion connectors into the upper panel portion connector sleeve; and lowering the panel onto the top of the plurality of upper panel portion connectors.

17. An apparatus comprising:

a lower panel portion;

an upper panel portion located within the lower panel portion, wherein the upper panel portion is slidably adjustable between a first and a second position;

a plurality of upper panel portion connectors; and an upper panel portion connector sleeve for receiving the plurality of upper panel portion connectors, whereby the plurality of upper panel portion connectors aids incremental position adjustment of the upper panel portion between the first position and the second position.

18. The apparatus of claim 17, further comprising:

a transitional connector;

a lower panel portion connector; and a lower panel portion connector sleeve for receiving the lower panel portion connector and the transitional connector.

19. An apparatus comprising:

a lower panel portion;

an upper panel portion located within the lower panel portion, wherein the upper panel portion is slidably positionable between a first position and a second position;

a plurality of upper panel portion connectors attachable to the upper panel portion;

a transition connector attachable to the upper panel portion and the lower panel portion; and a lower panel portion connector attachable to the lower panel portion.

20. The apparatus of claim 19, wherein the plurality of upper panel portion connectors aids incremental adjustment of the position of the upper panel portion.

21. The apparatus of claim 19, further comprising a plurality of rail and track sections that guide the upper panel portion.

* * * * *